United States Patent [19]

Bieri

[11] Patent Number: 4,932,597

[45] Date of Patent: Jun. 12, 1990

[54] CONCRETE PLATE, PANEL, WALL OR FLOORING DEMOLITION APPARATUS

[75] Inventor: Hans Bieri, Pfäffikon, Switzerland

[73] Assignee: Hydrostress AG, Pfäffikon, Switzerland

[21] Appl. No.: 280,381

[22] Filed: Dec. 5, 1988

[30] Foreign Application Priority Data

Dec. 9, 1987 [CH] Switzerland ..... 4795/87

[51] Int. Cl.[5] ..... B02C 1/00

[52] U.S. Cl. ..... 241/266; 125/23.01; 241/101.7

[58] Field of Search ..... 299/22; 241/101, 7, 241/1, 262–269, 301, 285 R; 225/103; 125/23 C

[56] References Cited

U.S. PATENT DOCUMENTS

| | | | |
|---|---|---|---|
| 2,557,098 | 6/1951 | Graham et al. | 125/23 C |
| 3,980,341 | 9/1976 | Musannie et al. | 241/1 X |
| 3,998,201 | 12/1976 | Miura et al. | 125/23 C |
| 4,203,414 | 5/1980 | McClain | 125/23 C |

FOREIGN PATENT DOCUMENTS

| | | | |
|---|---|---|---|
| 215878 | 11/1960 | Austria | 125/23 C |
| 2340188 | 3/1974 | Fed. Rep. of Germany | 241/101.7 |
| 2345625 | 3/1974 | Fed. Rep. of Germany | 241/101.7 |
| 3541786 | 8/1986 | Fed. Rep. of Germany . | |
| 2024042 | 1/1980 | United Kingdom | 241/101.7 |

*Primary Examiner*—Mark Rosenbaum

*Attorney, Agent, or Firm*—Frishauf, Holtz, Goodman & Woodward

[57] ABSTRACT

To provide a portable demolition apparatus for concrete slabs, plates or the like, a clamping arch (1) having two end portions (12, 13) is equipped with pointed bolts (15, 16; 17, 18) at the ends; at least one (16, 18) of the pointed bolts is coupled to a cylinder-piston arrangement (21) which, upon application of high hydraulic pressure in the order of for example 800 bar, drives the pointed bolt towards the other, thus cracking the concrete plate, slab or the like between the points. Hydraulic pressure is obtained from a separately located pressure source, which permits construction of the arch of lightweight material, with an overall weight of 50 kg or less, with a jaw clearance opening of 45 cm or less, application of hydraulic force being controlled by a pilot valve-control slider arrangement (23, 24) located directly on the clamping arch and coupled to the remotely located pressure source by suitable pressure hoses.

20 Claims, 5 Drawing Sheets

CONCRETE PLATE, PANEL, WALL OR FLOORING DEMOLITION APPARATUS

The present invention relates to an apparatus, and more particularly to a portable apparatus readily capable of breaking up or demolishing concrete plates, panels, wall structures, flooring strips, slabs or the like, and especially to such apparatus which operates without the use of reciprocating impacting apparatus.

BACKGROUND

To demolish rock walls, concrete walls, panels, floor structures and the like, it is usually necessary to use compressed-air drills or chisels or the like. While the destruction and demolition of concrete structures with compressed-air drills and chisels is efficient, it is accompanied by high noise, vibration, and generation of considerable dust. Further, the speed with which concrete structures, including slabs and the like, can be broken is quite limited.

THE INVENTION

It is an object to provide a concrete demolition apparatus, particularly adapted for breaking plate-like concrete structures, such as panels, walls, floors, slabs and the like, which is portable, and in operation is substantially less noisy than concrete drills and the like and does not subject the entire panel, and hence any surrounding structure to which it may be attached, to excessive vibration.

Briefly, a generally C-shaped frame of lightweight metal, and forming a clamping arch, has two end portions formed with coaxial bores in which essentially similar pointed pressure bolts are placed. The pointed pressure bolts face each other with their pointed ends and define a demolition axis, so that, upon moving them relatively towards each other, a concrete structure therebetween will be penetrated and will crack. A hydraulic piston-cylinder arrangement coaxial with the pressure bolts, or one of them, is coupled to at least one of the pressure bolts to move it with respect to the frame and hence the other one; the hydraulic piston-cylinder arrangement is coupled by a pressure hose to a source of pressurized hydraulic fluid.

It is readily possible to apply, by means of hydraulic pressure, a force of about 30 tons between the points of the pointed pressure bolts; yet, by using an open frame structure, the entire apparatus with which concrete structures are to be broken can be portable, weighing 50 kg or less, so that they can be handled by one operator. Coupling to a source of hydraulic pressure then is readily obtained by means of quick-release couplings to the pressure source.

The construction of the demolition apparatus in form of a portable lightweight metal framework, and the physical separation of generation of high hydraulic pressures from the structure which applies the pressure permits reducing the weight of the apparatus itself to the level that it can be carried by the operators, for example by two operators, thus permitting work taking place at locations which are poorly accessible to cranes, lifting apparatus, hoists and the like; further, the apparatus is readily adaptable to be coupled to the end of an operating arm of construction apparatus, for example a scoop from a back hoe, a rock drill extension and the like.

DRAWINGS

DETAILED DESCRIPTION

Figure 1:
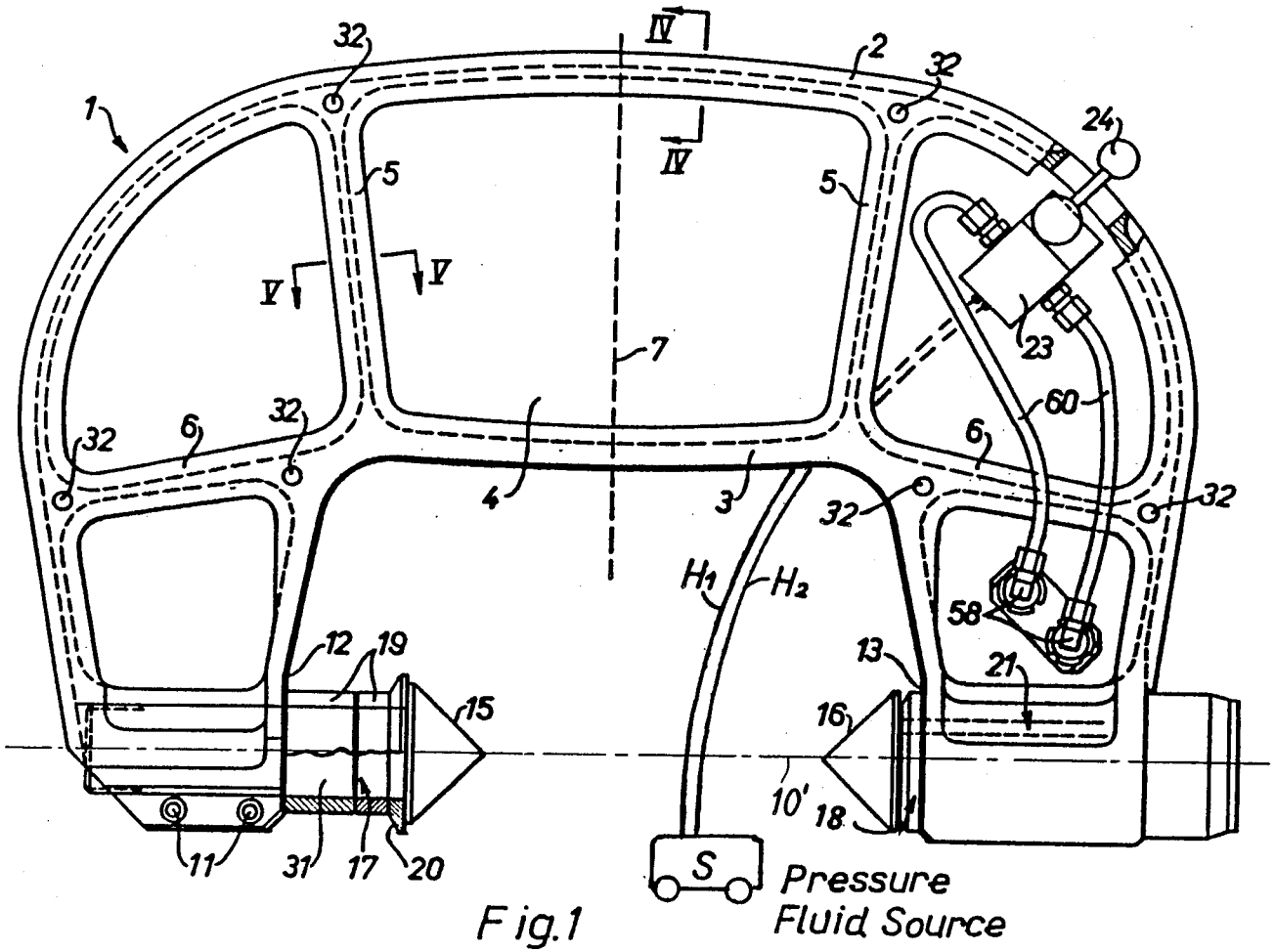
FIG. 1 is a simplified, schematic side view of the demolition apparatus.
Figure 4:
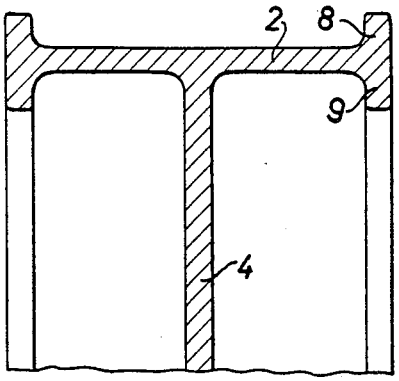
FIG. 4 is a cross section along line IV—IV of FIG. 1.
Figure 5:
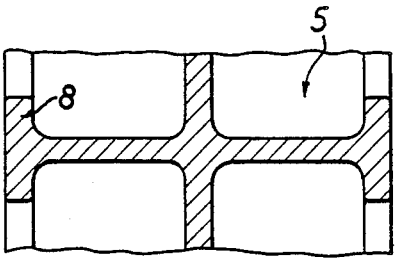
FIG. 5 is a cross section along line V—V of FIG. 1.

The apparatus, see FIG. 1, generally has the shape of a C-clamp 1, having a central portion and two leg portions. The central portion has the largest size. The C-clamp structure 1 preferably is made as a single unitary element from a metal plate made of lightweight material; by use of lightweight material, high resistance to bending and high stiffness against twisting is obtained, with minimum overall weight. The structure 1 is a plate structure having a central plate 4 positioned between an outer brace 2 and an inner brace 3, see also FIGS. 4 and 5. Reinforcement ribs 5 extend from the plate 4 (see FIG. 5). The ribs 5, in form of pairs, one at either side of a central axis 7, extend at an inclination towards the central axis as seen in FIG. 1, or they may be parallel to the central axis 7. Further reinforcement ribs 6 are provided, shorter than the ribs 5, which extend roughly at right angles to the central axis 7. The braces 2, 3 as well as the ribs 5, 6 terminate at their ends in a T-beam end structure, formed by stiffening ribs 8, 9, as seen in FIG. 4. This structure provides high resistance against twisting, bending, and deformation tending to spread the legs of the C-clamp apart.

Figure 6:
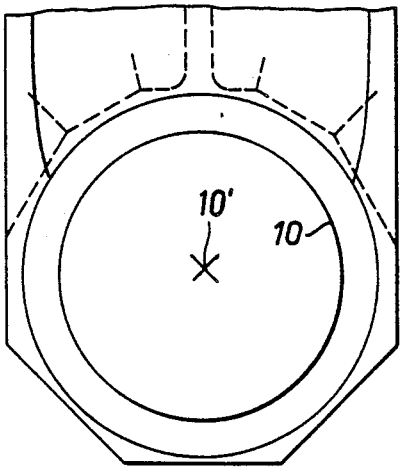
FIG. 6 is a view of the leg portion receiving the hydraulic cylinder, seen in the direction of the arrow A of FIG. 2.

The structure 1, adjacent the ends of the leg portions, forms a closed structure with a bore or circular opening 10 therein, adapted to receive a hydraulic piston-cylinder combination or arrangement. Bore 10 defines a bore axis 10' which, also, is the demolition axis of the apparatus. The two leg portions can be similar or dissilmilar. The leg portion of FIG. 6 is closed; the leg portion at the left side with respect to FIG. 1 has a slit therethrough and terminates in a flange which can be clamped by screws 11 about a pointed bolt 17, which fits into the opening 10.

The two leg portions 12, 13 of the structure form an open jaw 14, the maximum dimension of which is defined by the spacing between tips 15, 16 of pointed bolts 17, 18. The pointed bolt 17 is rigidly, releasably or adjustably secured in the bore 10 of the leg portion 12. The pointed bolt 18 is received in the bore 10 and is movable in a direction to close the opening of the jaw 14 under hydraulic pressure. The pointed bolt 17 can be extended by one or more spacer rings 19, located between the inner surface of the end portion 12 and the shoulder 20 of pointed bolt 17, and seated on a cylindrical shaft 31 which fits into the bore of the C-clamp structure 1.

The pointed bolt 18, at the right side with respect to FIG. 1, is movable to-and-fro coaxially with axis 10' under action of a double acting hydraulic cylinder-piston arrangement 21, so that the tip 16 thereof can be extended forwardly or retracted.

The hydraulic cylinder-piston arrangement 21 is a double-acting structure. A control slider 23, coupled to an operating handle 24, controls admission or drainage of pressurized fluid to operate the bolt 16 from a source S.

Figure 2:
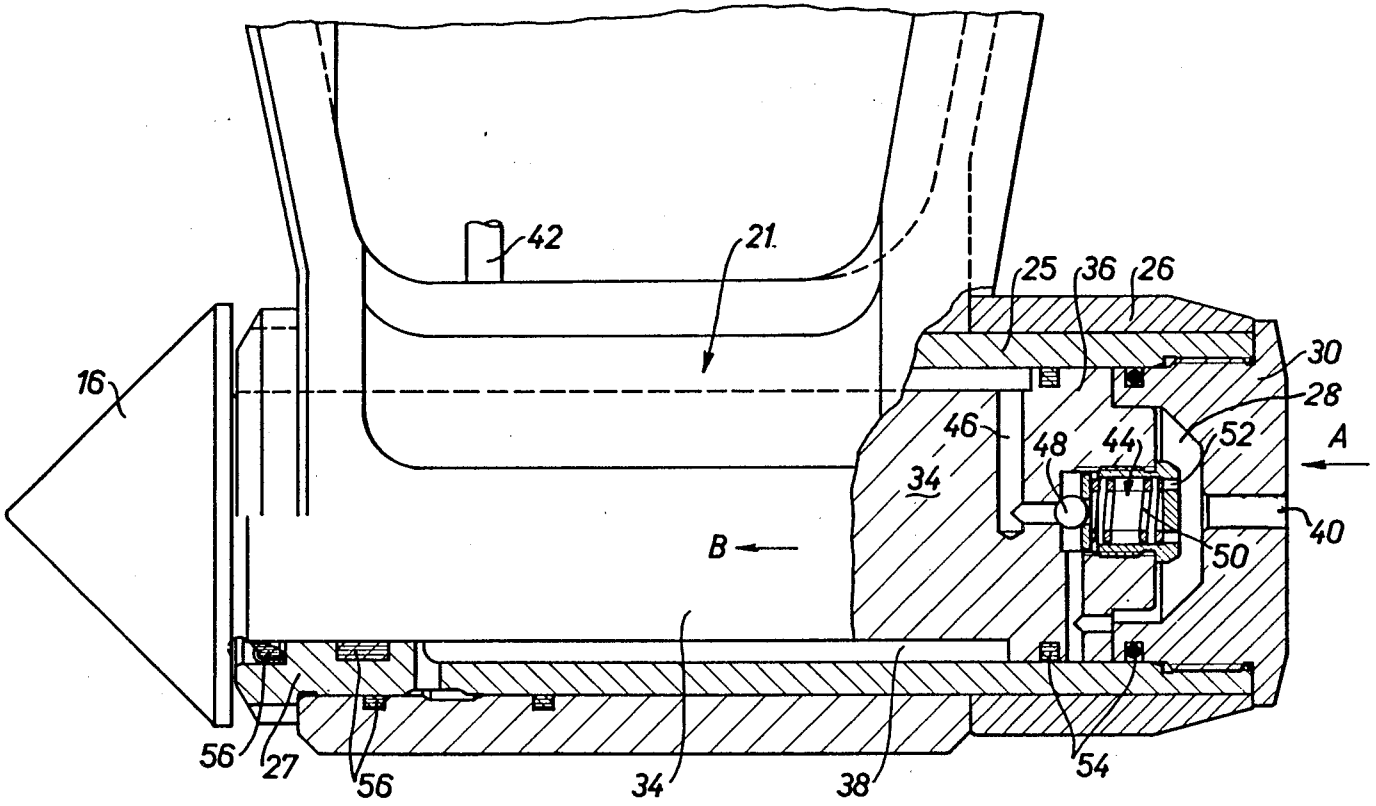
FIG. 2 is a fragmentary, part cross-sectional view through the hydraulic cylinder and the pressure bolt.

The details of the hydraulic structure are shown in FIG. 2; the hydraulic cylinder has a cylindrical sleeve 25 which is received in the bore 10 of the C-clamp structure 1. The rear end of the sleeve 25 is surrounded by a bushing 26 and tightly closed by a cover 30, which, for example, is screwed into the sleeve 25. A guide bushing 27 is inserted into the opening 10 at the end adjacent the jaw opening 14. A piston rod 34 is coupled to the bolt 16. A piston 36 forms the end of the piston rod 34. Piston 36, piston rod 34 and the tip portion 16 of the bolt element form an in-line coaxial system: they can be a single unitary structure or can be made of a plurality of elements all connected together. The piston 36 forms a first pressure chamber 28, positioned between the piston 36, the sleeve 25 and the cover 30. A second, ring-shaped pressure chamber 38 is formed between the sleeve 25, the piston rod 34, and the piston 36. Hydraulic pressure fluid under high pressure is supplied to the first pressure chamber 28 through a connecting line 40 in the cover 30. A drain line 42 permits drainage of hydraulic pressure fluid from the cylinder space 38. An overpressure valve 44 prevents the build-up of excessive pressure when the piston 36 reaches a terminal position. A radial bore 46 covers the second pressure space 38 with a ball valve formed by a ball 48. The ball 48 is biassed by a spring 50, so dimensioned that possible excess pressure in the second pressure space 38 can be drained through the first pressure space 28. The spring pressure at which time the safety valve formed by the ball will open can be adjusted by an adjustment screw 52, accessible through the bore 40.

Seals 54, 56 are provided to seal the high-pressure fluid in the respective cylinder spaces, the seals being located in the cover and in the sleeve. The connection between the control slider 23 and the ducts 40, 42 is obtained through high-pressure hoses or pipes 60 (FIG. 1) and couplers 58. The connecting couplers for high pressure fluid supply and for drainage of pressure fluid to the control slider 23 are on the side remote from the visible side in FIG. 1, and can be of any suitable well known construction.

OPERATION OF HYDRAULIC APPARATUS

Upon suitable operation of the pilot valve 23 by the handle 24 (FIG. 1), pressurized fluid can flow into the first pressure chamber 28, which moves the piston and hence the tip 16 of the bolt 18 in the direction of the arrow B of FIG. 2. At the same time, fluid is drained from the second pressure fluid chamber 38, which can flow out through the line 42. For return of the tip 16, in a direction counter the direction of the arrow B of FIG. 2, the handle 24 is moved into a "release" position, which then supplies pressurized fluid through the line 42 to the second chamber 38, and any fluid within the pressure chamber 38 can then drain over the line 40. The overpressure valve 44 prevents excessive pressure being applied by the piston when it is already in its end position.

The source S for high pressure fluid preferably is a mobile high-pressure pump, for example located on a cart, a vehicle trailer or the like, and having its own power source, for example an individual internal combustion engine. The high pressure hydraulic fluid is coupled over hoses H1 and H2 and releasable couplings to the structure 1 at the side remote from the showing of FIG. 1. This separation of the pressure source S from the demolition or cracking structure 1 permits constructing the structure 1 to be light enough so it can be carried by one or two operators.

Figure 3:
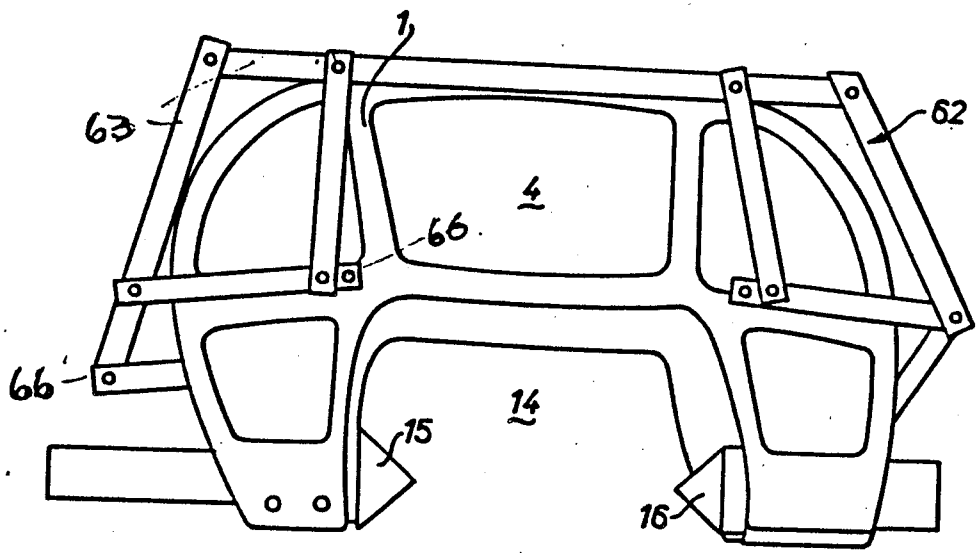
FIG. 3 is a schematic front view of the pressure bolt attached to a holding or attachment structure.

The structure 1 can be placed in defined positions at a demolition site by coupling it to a holding frame, as shown schematically in FIG. 3. The holding frame 62 is formed of rounded rods 63, preferably of lightweight metal. The holding frame is located at both sides of the structure 1 and retained thereon by screw-connected connection rods or bolts 66. The connection rods or bolts 66 can penetrate through suitable bores 32 (FIG. 1) formed in the frame 1. The holding frame 62 extends externally beyond the frame structure 1, so that it can be easily handled and placed in a desired position for application of compressive force against a plate, panel, slab or block or the like, and retained in position thereagainst as pressure is being applied between the tips 15, 16 or the pressure bolts 17, 18.

DEMOLITION OF A WALL STRUCTURE, PLATE, SLAB OR THE LIKE

The C-clamp structure, with the tips 15, 16 providing a clear opening somewhat larger than the structure to be demolished, for example a wall, plate or slab, is placed over the slab. The operating handle 24 is then operated to control the pilot valve 23 to apply high-pressure fluid, preferably high-pressure oil into the pressure chamber 28. A suitable pressure is, for example about 800 bar. The piston 36, and with it the tip 16, will then move in the direction of the arrow B (FIG. 2). The two tips 15, 16 are forced with a very high force into the structure until it splits. The control handle 24 is then changed, to shift-over the control valve 23 to retract the tip 16 by pressurizing the second pressure chamber 38; the frame 1 is then moved to a further position, for example beyond a terminal end of a crack, or close thereto, and the compression step which provides for penetration of the tips 15, 16 at another position is repeated.

In one embodiment, the structure 1 has a clear jaw opening measured between the tips of the points 15, 16 of somewhat less than 40 cm, preferably about 30 cm. The weight of such a structure, if constructed of lightweight metal, is somewhat less than 50 kg, and will be approximately, and preferably, about 45 kg. The force which can be applied between the tips or points 15, 16 will be about 30 tons with pressurized fluid providing a pressure of 780 bars.

Figure 7:
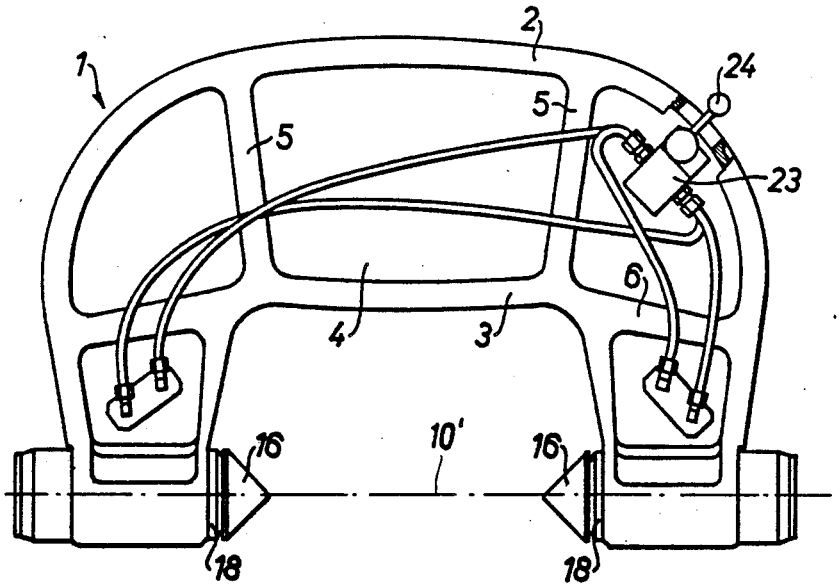
FIG. 7 is a view similar to FIG. 1, and illustrating the structure with two hydraulic cylinders.

In the embodiment illustrated, the clearance between the tips 15, 16, when the hydraulic cylinder is in its retracted position, can be adjusted to match the approximate thickness of the plate or slab to be cracked by use of one or more of the spacer rings 19 (FIG. 1). It is also possible to place two hydraulic units on the frame, one on either side. FIG. 7 illustrates a structure in which two hydraulic cylinders of essentially similar construction are located on the frame 1. They are preferably controlled from a single pilot valve unit 23, supplied from the same pressure source, so that movement of the two tips towards each other will be in synchronism. This arrangement permits increasing the overall stroke of the tips, all other conditions being equal.

The structure 1 is portable; for some applications, however, it may be desirable to attach it to structural and handling apparatus, for example by use of the frame 62 (FIG. 3) and/or of the attachment openings 32 (FIG. 1). Since, for such application, the unit may not be immediately readily accessible to operators when employed to crack a plate or slab, remote control for operation of the handle or of the valve 23 itself may be provided, and the double-acting structure of FIG. 7 is then also particularly suitable.

Various changes and modifications may be made, and any features described herein of any one of the embodiments may be used with any of the others, within the scope of the inventive concept.

A suitable lightweight material for clamp 1 is a titanium-aluminum alloy. The selection of the material is governed by the size as well as the desired degree of portability. A suitable material is a material similar to those used in high-strength lightweight structural configurations, for example in aircraft structures.

I claim:

1. Concrete plate, slab, panel, wall or floor demolition apparatus, comprising a generally C-shaped single, unitary metal frame forming a clamping arch (1), having two end portions (12, 13) forming end legs of the clamping arch, at least one end portion being formed with a bore (10) having a bore axis (10') facing the opposite end portion of the generally C-shaped clamping arch (1);

two coaxial pressure elements (17, 18), at least one of said pressure elements being a bolt having a pointed end (15, 16), located at the respective end portions of the clamping arch (1) and facing each other, the ponted end of said at least one pressure bolt extending along said bore axis (10') to define a demolition axis coaxial with said bore axis;

at least one (16, 18) of said pressure elements being movable relative to the metal frame (1);

a double acting hydraulic piston-cylinder arrangement (21) being coupled to said at least one movable pressure element and being coaxial with respect to said movable pressure element;

a pressure hose connection from the piston-cylinder arrangement (21) for coupling the piston-cylinder arrangement to a source (S) of pressurized hydraulic fluid; and a hydraulic control means (23, 24) hydraulically coupled to said piston-cylinder arrangement (21) for operating said piston-cylinder arrangement, and hydraulically additionally coupled to said source (S) of pressurized hydraulic fluid.

2. The apparatus of claim 1, wherein only one hydraulic cylinder-piston arrangement (21) is provided, coupled to only one of said pressure elements (15, 16);

and wherein the other of said pressure elements (15, 17) is retained in secure position at the end portion (12) of said C-shaped arch.

3. The apparatus of claim 2, further including intermediate spacer rings (19) for defining the position of said other of the pressure bolts (15, 17), located between the pressure bolt and a surface of the end portion (12) of said clamping arch.

4. The apparatus of claim 1, wherein said control means (23, 24) comprises a control unit secured to said clamping arch (1).

5. The apparatus of claim 1, wherein the metal frame comprises lightweight material and includes a generally C-shaped plate (4) and stiffening ribs (5, 6), unitary with said plate, and extending transversely to said plate.

6. The apparatus of claim 5, wherein said ribs terminate in a T-beam structure (8, 9).

7. The apparatus of claim 5, wherein said ribs further include end braces (2, 3) located at marginal edges of said plate (4) and unitary therewith; and wherein said ribs extend transversely from said end braces and are merged therewith to provide a stiff clamping arch resistant against spreading and twisting.

8. The apparatus of claim 7, wherein said ribs terminate in a T-beam structure (8, 9).

9. The apparatus of claim 1, further including a holding frame (62) secured to said clamping arch, and having frame portions extending beyond the outline of said clamping arch.

10. The apparatus of claim 9, wherein said holding frame comprises shaped rods;

and connecting bolts are provided for said shaped rods, said connecting bolts penetrating through openings (32) formed in said clamping arch (1).

11. The apparatus of claim 1, wherein two hydraulic piston-cylinder arrangements (21) are provided, one each being coupled to a pressure bolt, and one each being located at a respective leg portion (12, 13), both of said piston-cylinder arrangements being jointly coupled to the same source of pressurized hydraulic fluid.

12. The apparatus of claim 11, wherein said hydraulic control means (23, 24) comprises a single control unit interposed between said source (S) of pressurized hydraulic fluid and both of said hydraulic piston-cylinder arrangements for joint control of the two piston-cylinder arrangements by said single control unit.

13. The apparatus of claim 11, wherein both of said pressure elements are bolts which have pointed ends.

14. The apparatus of claim 1, wherein the distance between the ends (15, 16) of said pressure elements facing each other defines a jaw opening for said clamping arch;

wherein said jaw opening is only up to about 45 cm; and wherein the material of the frame is lightweight metal selected to provide for an overall weight of the apparatus of less than about 50 kg.

15. The apparatus of claim 1, wherein both of said pressure elements are bolts which have pointed ends.

16. Concrete plate, slab, panel, wall or floor demolition apparatus, comprising a generally C-shaped metal frame forming a clamping arch (1), having two end portions (12, 13) forming end legs of the clamping arch, each of said end portions being formed with a bore (10) having a bore axis (10') facing the opposite end portion, said bores (10) being in axial alignment, whereby the bore axes (10') of said bores will be coaxial;

two pressure bolts (17, 18), each of said pressure bolts having pointed ends (15, 16), said pressure bolts being located, each, in a respective bore (10) at the respective end portion of the clamping arch (1) and facing each other, with their pointed ends in coaxial alignment, and defining a penetration axis;

two double acting hydraulic piston-cylinder arrangements (21), one each being coupled to a pointed pressure bolt and one each being located at the respective end legs;

said hydraulic piston-cylinder arrangements being coaxial with respect to the pressure bolts and each includes a hydraulically displaceable means (34) operable in said penetration axis, both of said pressure bolts (17, 18) being movable relative to each other;

a hydraulic control unit (23, 24);

pressure hose connection means from the piston-cylinder arrangements (21) for coupling the piston-cylinder arrangements to said hydraulic control unit (23, 24); and a source (S) of pressurized hydraulic fluid coupled to said hydraulic control unit (23, 24) for joint control of said piston-cylinder arrangements by said hydraulic control unit.

17. The apparatus of claim 16, wherein said piston-cylinder arrangements (21) comprise a cylinder (25), each, located in a respective bore;

and wherein said hydraulically displaceable means comprise piston rods (34) operable within the respective cylinder, and coupled to the respective pressure bolt, whereby said cylinder, piston rod, pressure bolts and pointed ends will be coaxial with respect to each other and operable along said penetration axis (10').

18. The apparatus of claim 16, wherein the metal frame comprises lightweight material and includes a generally C-shaped plate (4) and stiffening ribs (5, 6), unitary with said plate, and extending transversely to said plate.

19. The apparatus of claim 16, wherein the distance between the pointed ends (15, 16) of said pointed pressure bolts facing each other defines a demolition jaw opening for said clamping arch, said demolition jaw opening being only up to about 45 cm; and wherein the material of the frame is lightweight metal selected to provide for an overall weight of the apparatus of less than about 50 kg.

20. The apparatus of claim 16, wherein said control unit is secured to said clamping arch (1).

* * * * *